US010527238B1

(12) United States Patent
Huang et al.

(10) Patent No.: US 10,527,238 B1
(45) Date of Patent: Jan. 7, 2020

(54) LAMP

(71) Applicant: ELEMENTS PERFORMANCE MATERIALS LIMITED, Kaohsiung (TW)

(72) Inventors: Kuo-Sung Huang, Kaohsiung (TW); Jerryson Lee, Kaohsiung (TW)

(73) Assignee: ELEMENTS PERFORMANCE MATERIALS LIMITED, Kaohsiung (TW)

( * ) Notice: Subject to any disclaimer, the term of this patent is extended or adjusted under 35 U.S.C. 154(b) by 0 days.

(21) Appl. No.: 16/517,279

(22) Filed: Jul. 19, 2019

(30) Foreign Application Priority Data

May 17, 2019 (TW) ..... 108117140 A

(51) Int. Cl.

| | |
|---|---|
| ***F21S 2/00*** | (2016.01) |
| ***F21V 23/00*** | (2015.01) |
| ***F21V 5/04*** | (2006.01) |
| ***F21V 23/04*** | (2006.01) |
| ***F21V 15/015*** | (2006.01) |
| ***F21Y 115/10*** | (2016.01) |

(52) U.S. Cl.
CPC ..... *F21S 2/005* (2013.01); *F21V 5/04* (2013.01); *F21V 15/015* (2013.01); *F21V 23/001* (2013.01); *F21V 23/0471* (2013.01); *F21Y 2115/10* (2016.08)

(58) Field of Classification Search
CPC ..... F21S 2/005; F21S 8/085; F21V 23/007; F21V 23/001; F21V 23/008
See application file for complete search history.

(56) References Cited

U.S. PATENT DOCUMENTS

| | | | | |
|---|---|---|---|---|
| 8,066,404 | B2 * | 11/2011 | Song | F21S 2/005 362/219 |
| 8,087,807 | B2 * | 1/2012 | Liu | F21S 2/005 362/373 |
| 8,157,420 | B2 * | 4/2012 | Song | F21V 15/013 362/294 |
| 9,857,037 | B1 * | 1/2018 | Wu | F21S 4/28 |
| 9,869,435 | B2 * | 1/2018 | DeCarr | F21S 8/061 |
| 2010/0118534 | A1 * | 5/2010 | Lo | F21S 2/005 362/249.02 |
| 2011/0013392 | A1 * | 1/2011 | Little, Jr. | F21S 8/086 362/235 |

(Continued)

*Primary Examiner* — William N Harris
(74) *Attorney, Agent, or Firm* — Li & Cai Intellectual Property (USA) Office

(57) ABSTRACT

A lamp includes main bodies, casings, two joint fixing members, two cover plates, a control module and lighting-emitting modules. Each of the lighting-emitting modules is disposed on a side of each of the main bodies and is electrically connected to the control module. Each of the main bodies has a casing fixedly disposed on a side opposite to the lighting-emitting module. A passage is formed between the casing and the main body. The lighting-emitting module has a light-transmitting component and a plurality of light-emitting units corresponding to a plurality of lens structures of the light-transmitting component. The joint fixing members are fixed to at least one of the main bodies and the casings such that the main bodies and the casings are arranged side by side. The passages communicate with each other to form a through passage with the control module disposed therein.

10 Claims, 14 Drawing Sheets

(56) References Cited

U.S. PATENT DOCUMENTS

| | | | | |
|---|---|---|---|---|
| 2011/0032696 | A1* | 2/2011 | Kim | F21S 2/005<br>362/184 |
| 2012/0106152 | A1* | 5/2012 | Zheng | F21S 2/005<br>362/249.02 |
| 2013/0003378 | A1* | 1/2013 | Dube | F21S 8/086<br>362/249.03 |
| 2013/0027935 | A1* | 1/2013 | Ladewig | F21S 2/00<br>362/249.01 |
| 2015/0354794 | A1* | 12/2015 | Guercio | F21V 21/30<br>362/235 |

* cited by examiner

LAMP

CROSS-REFERENCE TO RELATED PATENT APPLICATION

This application claims the benefit of priority to Taiwan Patent Application No. 108117140, filed on May 17, 2019. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a lamp, and more particularly to a lamp used in large-scale activity spaces such as factories and department stores.

BACKGROUND OF THE DISCLOSURE

In order to cope with different customer requirements for lamps, such as the volumes and sizes thereof according to their spaces, and especially for high bay lamps, most lamp manufacturers have to produce lamps with different sizes and brightness to meet these requirements. However, producing lamps with different sizes and brightness can cause an increase in production costs and difficulties in inventory management for the manufacturers.

SUMMARY OF THE DISCLOSURE

In response to the above-referenced technical inadequacies, the present disclosure provides a lamp.

In one aspect, the present disclosure provides a lamp including a plurality of main bodies, a plurality of casings, two cover plates, two joint fixing members, a control module, and a plurality of lighting-emitting modules. Each of the main bodies has a through hole passing through the main body. Two side surfaces of each of the main bodies opposite to each other are defined as a first mounting surface and a second mounting surface. Each of the casings is bar-shaped and includes a top wall, two side walls and two fixing walls. The top wall, the two side walls and the two fixing walls are integrally formed. Side edges of the top wall opposite to each other extend toward a first direction to form the two side walls, respectively, and the two side walls face each other. Two side edges of the two side walls opposite to the side edges connected to the top wall extend toward a second direction to form the two fixing walls, and the second direction is not parallel to the first direction. The two fixing walls of each of the casings are fixedly disposed on the main body. The top wall, the two side walls and the first mounting surface jointly form a passage. The through hole of the main body is correspondingly located in a region defined by an orthographic projection in a direction from the top wall toward the main body. A length of each of the fixing walls in a lateral direction is equal to a length of a short side edge of the main body in the lateral direction. A sum of a length of each of the top walls of each of the casings in a length direction and lengths of the two fixing walls in the length direction is not greater than a length of a long side edge of the main body in the length direction. The plurality of casings are arranged side by side and defined as a casing group. The plurality of casings of the casing group have the plurality of passages communicating with each other to form a through passage. The plurality of main bodies are arranged side by side and defined as a main body group. The two joint fixing members each are used to fix at least one of the casing group and the main body group. The two cover plates are fixedly disposed on two sides of the plurality of casings and the plurality of main bodies arranged side by side with each other. The two cover plates close off openings at two ends of the through passage, respectively. The two cover plates, the first mounting surfaces of the plurality of main bodies and the plurality of casings jointly form a closed space. The control module is fixedly disposed in at least one of the plurality of main bodies and located in the closed space. Each of the plurality of lighting-emitting modules is fixedly disposed on the second mounting surface of each of the main bodies. Each of the lighting-emitting modules has a circuit board, a plurality of lighting-emitting units and a light-transmitting component. The circuit board is fixedly disposed on the second mounting surface of the main body. The plurality of lighting-emitting units are fixedly disposed on a side of the circuit board away from the second mounting surface. The light-transmitting component is fixedly disposed on a side of the circuit board away from the second mounting surface, and the light-transmitting component correspondingly covers the plurality of lighting-emitting units. Each of the light-transmitting components includes a plurality of lens structures. The plurality of lighting-emitting units correspond to the plurality of lens structures.

A light beam emitted by each of the lighting-emitting units radiates outward through the corresponding lens structure. Each of the light-transmitting components has a light-emergent surface. A portion of the light beams emitted by the plurality of light units directly passes through the light-emergent surface to radiate outward. The portion of the light beams emitted by the plurality of light units is guided by the lens structures to radiate toward an optical axis close to the lens structures. Each of the lighting-emitting modules has at least one electrical connection line. The electrical connection line is electrically connected to the control module in the closed space through the through hole, and the control module controls each of the lighting-emitting modules.

The beneficial effects of the present disclosure are as follows: each of the casings and each of the main bodies of the lamp of the present disclosure are respectively the same but independent components. The manufacturers can change the length of the joint fixing member in an appropriate manner according to different requirements for brightness from customers so that the predetermined number of the casings and the main bodies are fixed to each other to arrange the lighting-emitting modules side by side. In other words, the lamp of the present disclosure allows the manufacturers to satisfy different requirements for brightness only by changing the length of the joint fixing member, so that the manufacturers do not need to build particular molds for different requirements for brightness, and the production costs can be reduced greatly.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
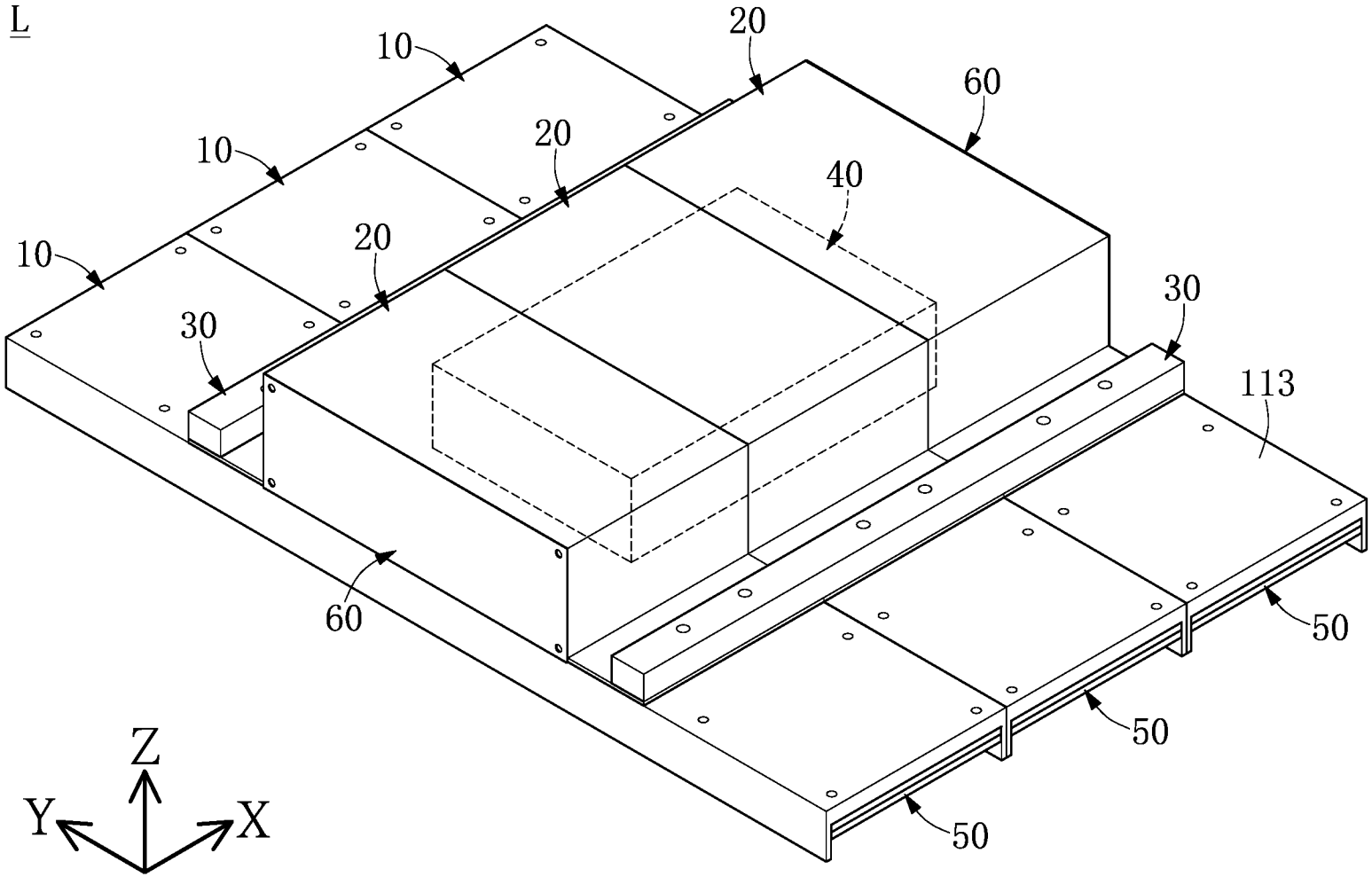
FIG. 1 and FIG. 2 are assembled schematic views of different viewing angles of a lamp according to a first embodiment of the present disclosure.
Figure 2:
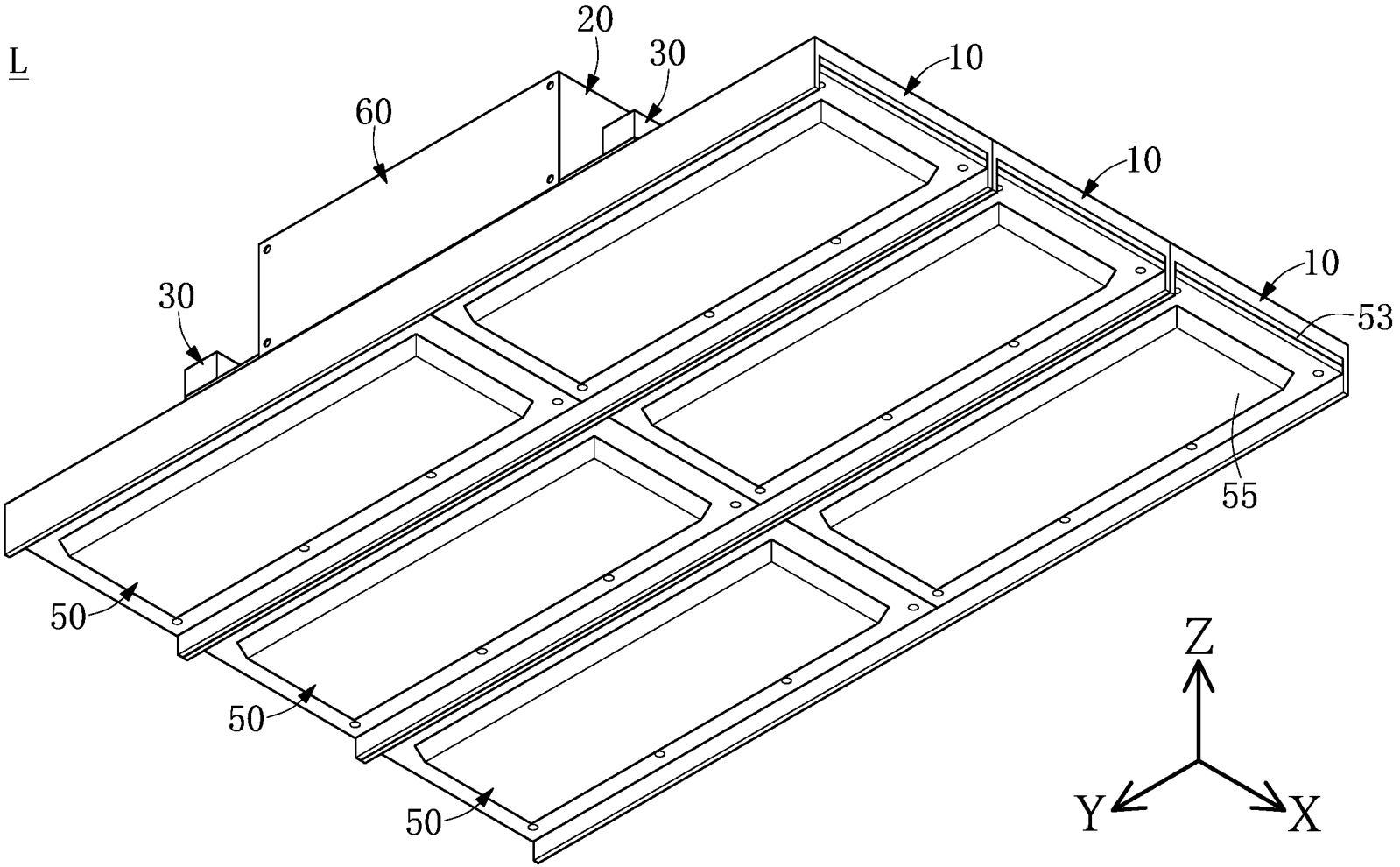

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

FIG. 1 to FIG. 5 are schematic views of a first embodiment of the present disclosure. A lamp L includes: three main bodies 10, three casings 20, two joint fixing members 30, a control module 40, six lighting-emitting modules 50 and two cover plates 60. The three main bodies 10 are disposed side by side; the two joint fixing members 30 fix the three casings 20 on a side of the three main bodies 10, and the three casings 20 are arranged side by side; the six lighting-emitting modules 50 are arranged in pairs and correspondingly disposed on a side of the three main bodies 10; the two cover plates 60 are disposed on a side of two of the casings 20 at both ends of the lamp L. It should be noted that in the figures of this embodiment, the lamp L has the three main bodies 10, the three casings 20 and each of the main bodies 10 is disposed with the two lighting-emitting modules 50. However, the numbers of the main bodies 10, the casings 20 and the lighting-emitting modules 50 of the lamp L are not limited thereto, and can be increased or decreased according to brightness requirements.

Further, each of the main bodies 10 is bar-shaped, and a groove 101 is formed in a recess of a side of each of the main bodies 10. The main body 10 has a bottom wall 11 and two side walls 12. The two side walls 12 are formed by extending two opposite side edges of the bottom wall 12 in the same direction. The bottom wall 11 and the two side walls 12 are integrally formed, and jointly form the groove 101. An inner side surface 121 of the two side walls 12 may be disposed facing each other. In practical applications, the inner surface 121 of the two side walls 12 can absorb the light beam emitted by the lighting-emitting module 50, thereby reducing the chance of glare in the lamp L.

The bottom wall 11 of the main body 10 may have a plurality of locking holes 111 in cooperation with the lighting-emitting module 50. The lighting-emitting module 50 can be fixedly disposed in the main body 10 with a plurality of lock members (such as screws), and correspondingly located in the groove 101. In different applications, the main body 10 can be made of a metal material having a high thermal conductivity, and a portion of the main body 10 can further have a fin structure so as to improve the overall heat dissipation efficiency.

The bottom wall 11 of the main body 10 can further have at least one through hole 112 passing through the main body 10. Since the groove 101 is communicated with the outside through the through hole 112, at least one electrical connection line 51, which is included in the lighting-emitting module 50 in the groove 101, can pass through the through hole 112 from the groove 101 and be disposed at a side of the lighting-emitting module 50 opposite to the groove 101 so as to be electrically connected to the control module 40. The number of the through holes 112 and the position of the through hole 112 can be changed according to requirements and are not limited to the drawings.

Each of the casings 20 is generally bar-shaped and includes a top wall 21, two side walls 22 and two fixing walls 23. The top wall 21, the two side walls 22 and the two fixing walls 23 are integrally formed. Two side edges of the top wall 21 opposite to each other extend toward a first direction to form the two side walls 22, respectively, and the two side walls 22 face each other. That is, the top wall 21 and the two side walls 22 are presented as an inverted U shape. Side edges of the two side walls 22 opposite to the side edges connected to the top wall 21 extend toward a second direction to form the two fixing walls 23. That is, each of the side walls of each of the casings 20 and the fixing walls 23 are presented as an L shape. The second direction is not parallel to the first direction, and the second direction may be perpendicular to the first direction, but not limited thereto.

A side of the bottom wall 11 of the main body 10 opposite to the groove 101 is defined as a first mounting surface 113, a side of the bottom wall 11 opposite to the first mounting surface 113 is defined as a second mounting surface 114. That is, the second mounting surface 114 is located at the bottom of the groove 101. The two fixing walls 23 of each of the casings 20 are fixedly disposed at the main body 10, each of the fixing walls 23 may be attached to the first mounting surface 113, and the top wall 11, the two side walls 22 and the first mounting surface 113 jointly form a passage T1. The through hole 112 of the main body 10 is correspondingly located in a region defined by an orthographic projection in a direction from the top wall 21 toward the main body 10. That is, the through hole 112 of the main body 10 is covered by the top wall 21 and the groove 101 communicates with the passage T1 through the through hole 112. The fixing wall 23 can be fixed to the first mounting surface 113 by screws, adhesives and welding, and is not limited thereto.

A length D1 of each of the fixing walls 23 in a lateral direction (i.e., an X-axis direction in FIG. 3) is equal to a length D2 of a short side edge of the main body 10 in the lateral direction, and a sum of a length D3 of each of the top walls 21 of each of the casings 20 in a length direction and lengths D4 of the two fixing walls 23 in the length direction is not greater than a length D5 of a long side edge of the main body 10 in the length direction. That is to say, the casing 20 is located directly above the main body 10, and the top wall 21, the side walls 22 and the fixing walls 23 of the casing 20 do not protrude from the two long side edges of the main body 10.

One of the joint fixing members 30 is fixed to one of the fixing walls 23 of the casings 20 and the main bodies 10, the other joint fixing member 30 is fixed to the other fixing wall 23 of the casings 20 and the main bodies 10, and the main bodies 10 and the casings 20 are disposed side by side by the two fixing members 30. That is, the two joint fixing members 30 are correspondingly disposed on two opposite sides of the casings 20.

It should be noted that in particular applications, the joint fixing member 30 may also have a plurality of heat dissipating fin structures (not shown). The joint fixing member 30 can not only be used to fix the main bodies 10 and the casing 20, but rapidly dissipate heat generated by the operation of the lighting-emitting module 50 outward through the plurality of heat dissipating fin structures.

The joint fixing member 30, the casing 20 and the main body 10 can be connected to each other as they have corresponding thru-holes respectively, and the screws can be used in cooperation with the thru-holes such that the joint fixing member 30, the casing 20 and the main body 10 can be fixed to each other. However, the present disclosure is not limited thereto. In different applications, the joint fixing member 30 can be fixed to the fixing wall 23 by an auxiliary component such as an adhesive or a solder. In addition, the joint fixing member 30 and the fixing wall 23 of the casing 20 may also have an engaging structure corresponding to each other. For example, the fixing wall 23 may be formed with a groove, and the joint fixing member 30 may have a corresponding rib, such that the rib of the joint fixing member 30 can be engaged in the groove disposed in the fixing wall 23. That is to say, the joint fixing member 30 and the casing 20 can be fixed to each other not only by screws, but by an engaging structure to be engaged to each other.

The plurality of passages T1 of the plurality of casings 20 communicate with each other to form a through passage. The control module 40 is fixedly disposed in at least one of the main bodies 10, and located on a side of the main bodies 10 opposite to the groove 101, and the control module 40 is correspondingly located in the through passage.

In a different application, the control module 40 may have at least one electrical connection socket (not shown), the electrical connection line 51 of each of the lighting-emitting modules 50 passing through the corresponding through hole 112 of the main body 10 may be connected to an electrical connection plug (not shown), and the electrical connection plug can be plugged into the electrical connection socket, such that the lighting-emitting module 50 can be electrical connected to the control module 40. In this way, relevant personnel can easily install and replace the lighting-emitting module 50. Since the control module 40 is electrically connected to the lighting-emitting module 50 through the electrical connection line 51, the control module 40 is able to control the operation of each of the lighting-emitting modules 50, for example, turning on or off the lighting-emitting module 50, and controlling the brightness and the color temperature of the light beam emitted by each of the lighting-emitting modules 50. The control module 40 can be electrically connected to an external power supply device (grid power), and convert the grid power to a predetermined voltage and current to provide each of the lighting-emitting modules 50. In different applications, the control module 40 can further have a wireless communication unit and be electrically connected to an external electronic device through the wireless communication unit, such that the relevant personnel can connect the control module 40 through the external electronic device to control each of the lighting-emitting modules 50. The external electronic device can be such as a smart phone and an industrial portable electronic device.

The six lighting-emitting modules 50 are arranged in pairs and disposed in the groove 101 of one of the main bodies 10, but the number of the lighting-emitting modules 50 disposed in each of the main bodies 10 is not limited thereto and can be changed according to practical requirements. That is, each of the main bodies 10 can be disposed with three or more lighting-emitting modules 50, or the main body 10 can also be provided with only one single light module 50. In the embodiment in which the groove 101 of the main body 10 is provided with the two lighting-emitting modules 50, when the groove 101 of the main body 10 is provided with only one single lighting-emitting module 50, the area of the main body 10 not provided with the light module 50 can be disposed with auxiliary heat dissipating components such as heat dissipating fins, so as to assist in dissipating the heat generated by the operation of the lighting-emitting module 50.

Each of the lighting-emitting modules 50 has the electrical connection line 51, a circuit board 53, a plurality of lighting-emitting units 54 and a light-transmitting component 55. The circuit board 53 is fixedly disposed on the main body 10 and can be attached to the second mounting surface 114. The plurality of lighting-emitting units 54 are fixedly disposed on a side of the circuit board 53 away from the second mounting surface 114. The light-transmitting component 55 is fixedly disposed on the side of the circuit board 53 away from the second mounting surface 114, and the light-transmitting component 55 correspondingly covers the plurality of lighting-emitting units 54. Each of the lighting-emitting units 54 is, for example, a variety of light emitting diodes, which can be selected according to requirements.

The size of the circuit board 53 is smaller than that of the bottom wall 11, so that the circuit board 53 can be fixedly disposed on a side of the second mounting surface 114 of the bottom wall 11.

Each of the light-transmitting components 55 has a light-emergent surface 551 and includes a plurality of lens structures 55A. Each of the lens structures 55A can be a truncated cone structure. The plurality of lighting-emitting units 54 correspond to the plurality of lens structures 55A, and most light beams emitted by the lighting-emitting units 54 radiate outward through the corresponding lens structures 55A and the light-transmitting component 55. The lens structure 55A is used to change a path of the light beam. For example, the lens structure 55A can be used to concentrate the light beam emitted by the lighting-emitting unit 54 toward an optical axis of the lens structure 55A. In practical applications, the light-transmitting component 55 and the plurality of lens structures 55A can be integrally formed, or the light-transmitting component 55 may include a casing fixed to the lens structures 55A after the lens structures 55A are separately manufactured.

Each of the light-transmitting components 55 may include one light-emergent surface 551 and four side light-emergent surfaces 552. The four side light-emergent surfaces 552 are connected to the periphery of the light-emergent surface 551, and the light-emergent surface 551 may be an end surface 13 not protruding from the main body 10 and having a recess forming the groove 101. In this way, the light beams emitted by the side light-emergent surfaces 552 of the light-transmitting component 55 can easily be blocked by the side walls 12 of the main body 10 and will not radiate outward, thereby greatly reducing the chance of glare in the lamp L. In practical applications, the inner side surface 121 of the side wall 12 can be provided with a light absorbing structure. The light absorbing structure includes such as a microstructure and a light absorbing coating including a plurality of regular or irregular arrays, such that the light absorbing structure can absorb the light beams emitted by the side light-emergent surface 552 to prevent the light beams from radiating outward and causing a glare in the lamp L.

Two cover plates 60 are fixedly disposed on two sides of the plurality of casings 20 and the plurality of main bodies 10 arranged side by side with each other. Each of the cover plates 60 cooperates with the lock members (such as screws) to be fixedly disposed on the corresponding casings 20. After the two cover plates 60 are respectively fixed to the two casings 20, the two cover plates 60 cover two ends of the through passage correspondingly to close the through passage. That is to say, the two cover plates 60, the first mounting surfaces 113 of the plurality of main bodies 10 and the plurality of casings 20 jointly form a closed space, and the control module 40 is fixedly disposed in the closed space. In practical applications, the cover plates 60 and the casing 20 may be connected to each other by waterproof components (such as waterproof rubber strips or waterproof gaskets) or the like, so as to prevent external moisture and dirt from entering the closed space.

Figure 3:
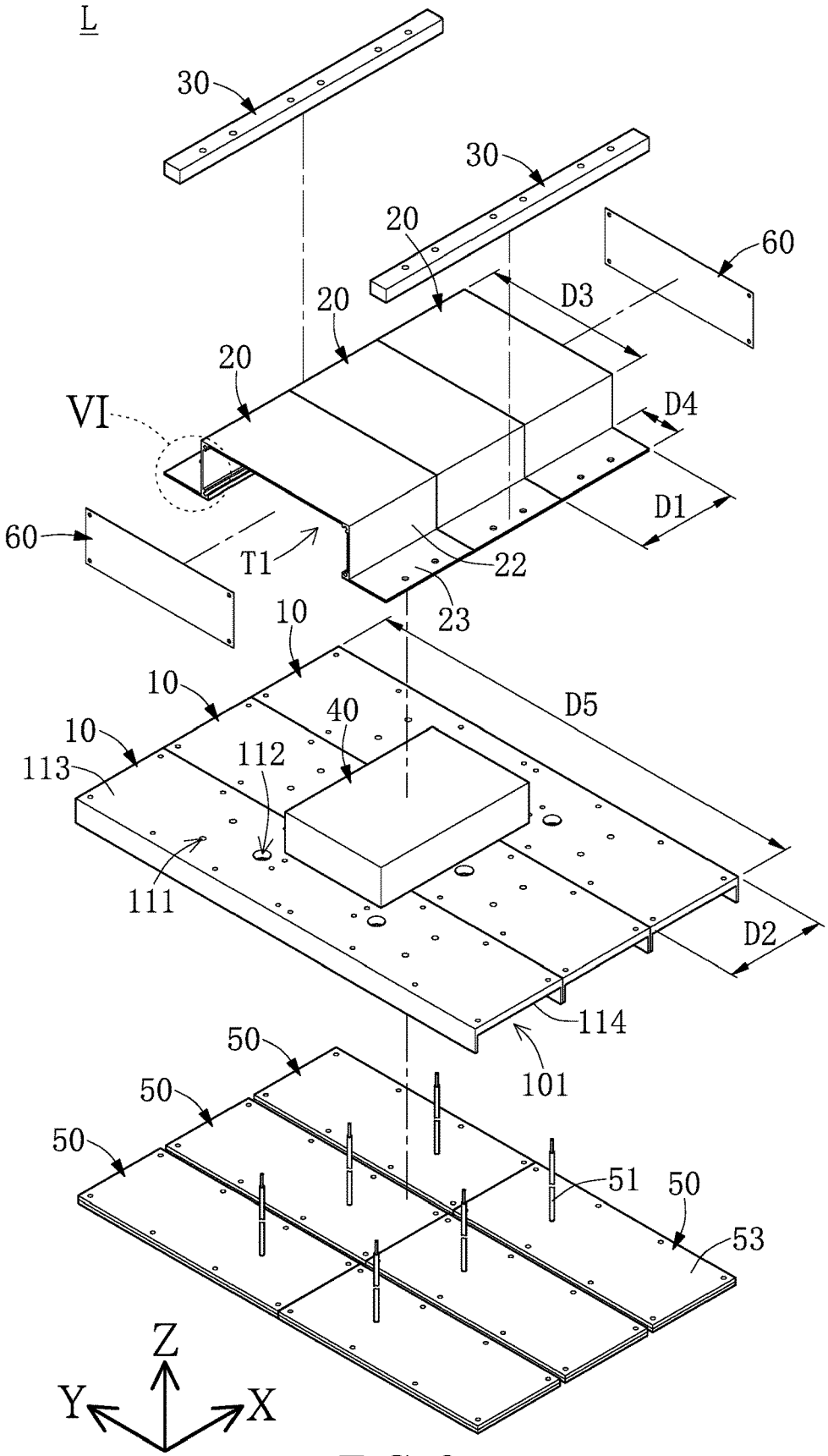
FIG. 3 and FIG. 4 are exploded views of different viewing angles of the lamp according to the first embodiment of the present disclosure.
Figure 4:
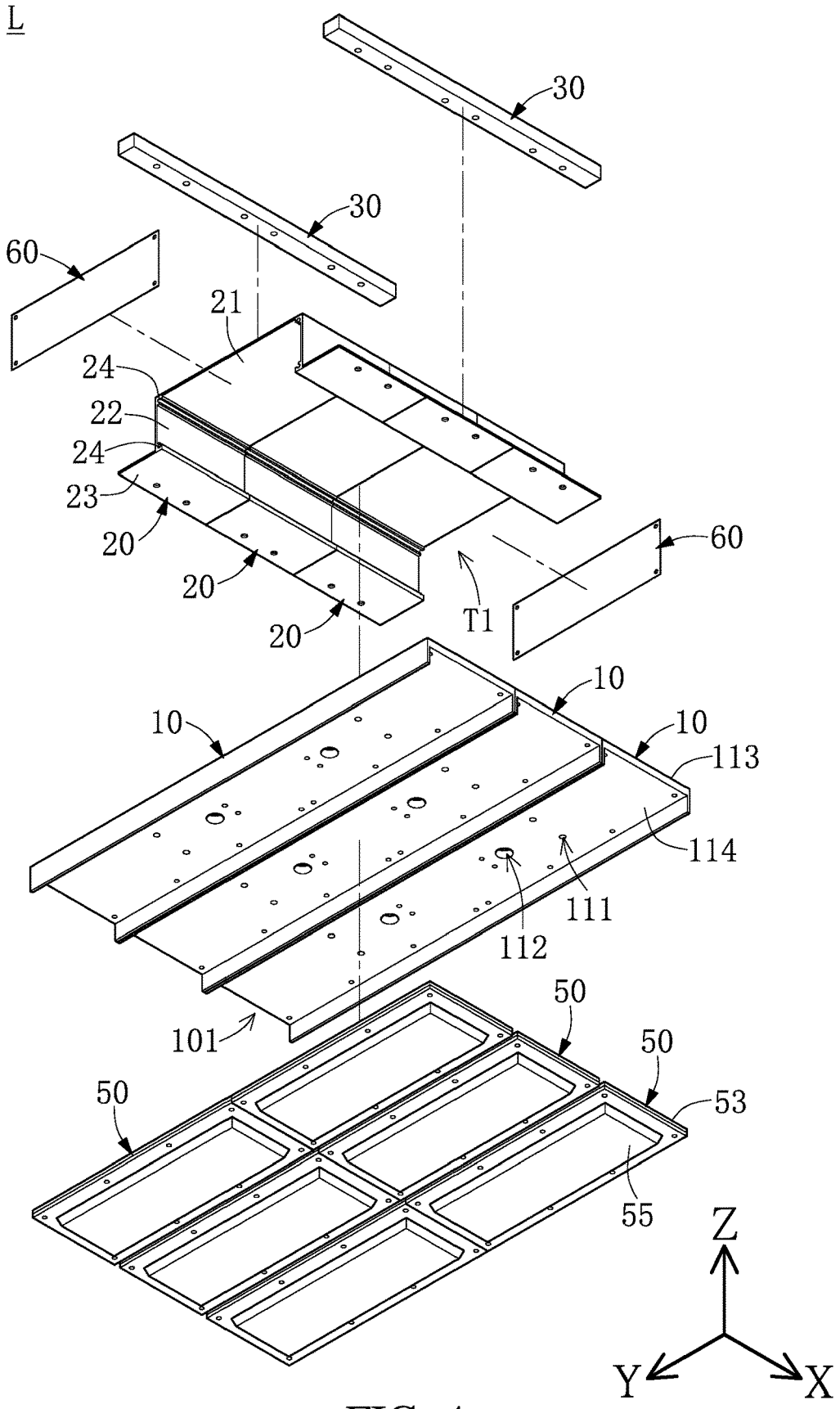
Figure 5:
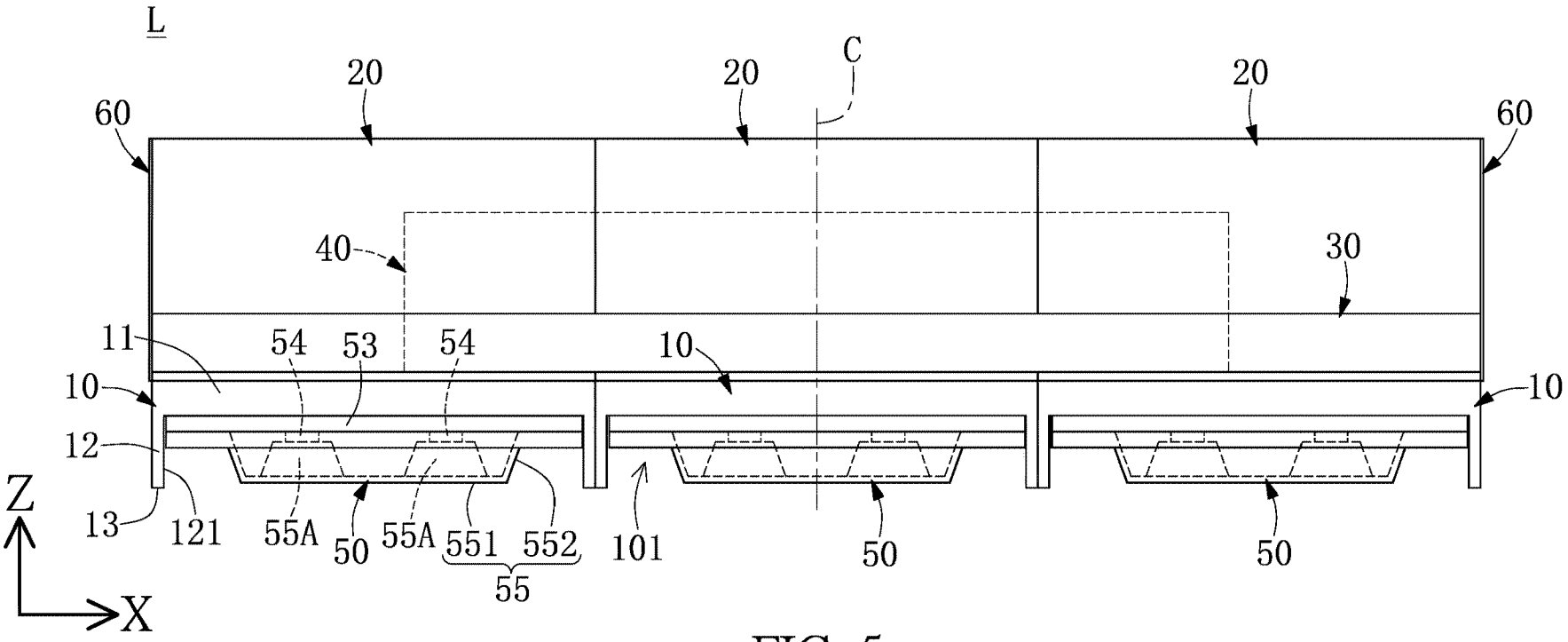
FIG. 5 is a side view of the lamp according to the first embodiment of the present disclosure.
Figure 6:
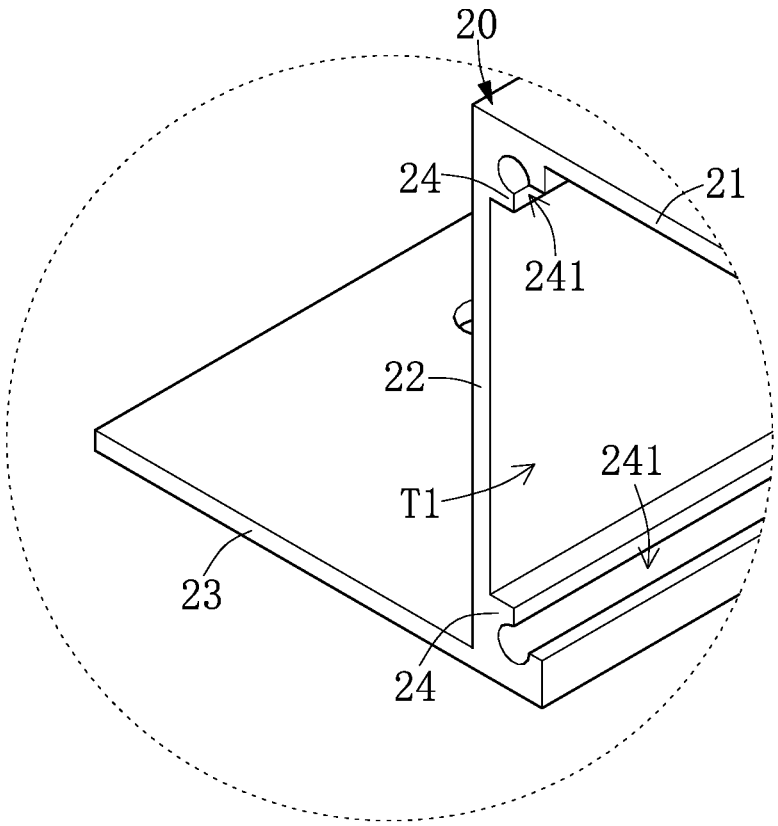
FIG. 6 is a partially enlarged schematic view of the lamp according to the first embodiment of the present disclosure.
Figure 7:
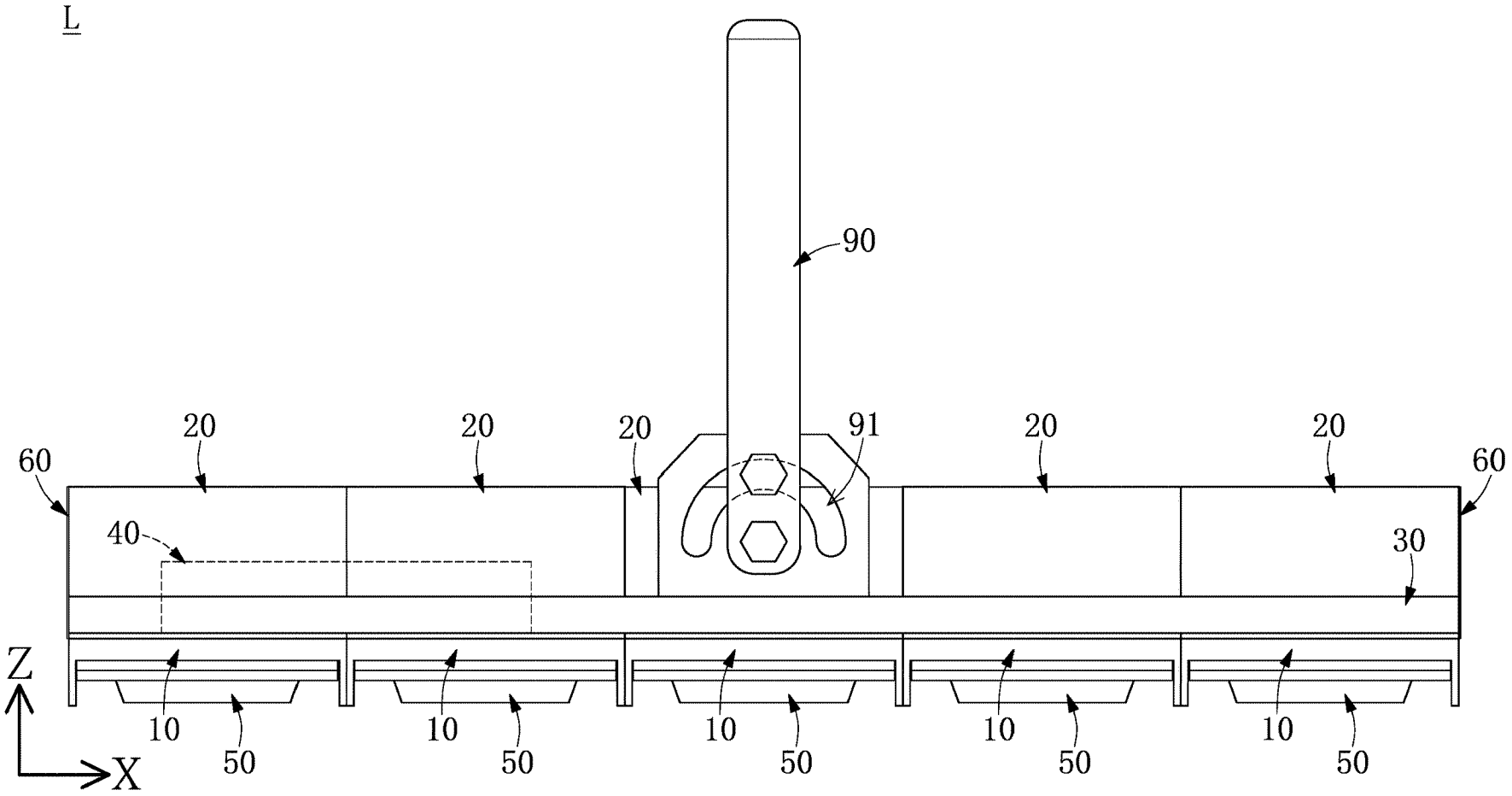
FIG. 7 is a side view of the lamp according to a second embodiment of the present disclosure.

Referring to FIG. 6 and FIG. 7, FIG. 6 is a partially enlarged schematic view of FIG. 3 and FIG. 7 is a partially enlarged schematic view of another embodiment. In FIG. 6, each of the casings 20 faces a side of the main body 10 and may be formed with at least one auxiliary fixing structure 24. Specifically, each of the casings 20 may have four auxiliary fixing structures 24. Two of the auxiliary fixing structures 24 are respectively formed at positions where the top wall 21 is connected to the two side walls 22, and the other two of the auxiliary fixing structures 24 are formed at positions where the two side walls 22 are connected to the two fixing walls 23, but is not limited thereto. Each of the auxiliary fixing structures 24 may have a locking hole, and each of the cover plates 60 can cooperate with the auxiliary fixing structure 24 through a lock member (such as a screw) to be fixed to a side of the casing 20.

FIG. 7 is a schematic view of the lamp according to a second embodiment of the present disclosure. The difference between this embodiment and the aforementioned embodiment is that: the lamp L can further include a handle structure 90. The handle structure 90 is fixedly disposed on at least one of the plurality of main bodies 10. The handle structure 90 includes a pivot structure 91, and the handle structure 90 is rotated relative to the connected main body 10 through the pivot structure 91. With the handle structure 90, the relevant personnel can adjust a tilt angle of the entire lamp L.

Figure 8:
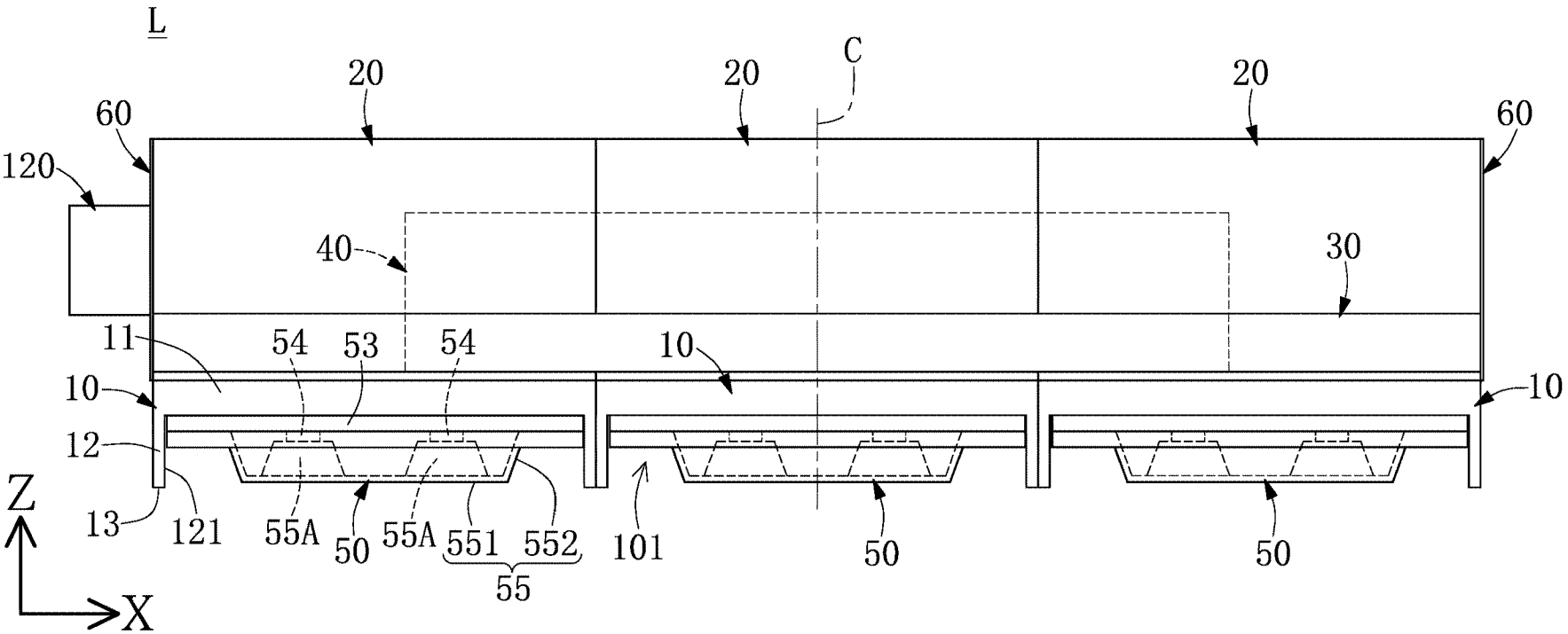
FIG. 8 is a front view of the lamp according to a third embodiment of the present disclosure.

FIG. 8 is a schematic view of the lamp according to a third embodiment of the present disclosure. The difference between this embodiment and the aforementioned embodiment is that: the lamp L can further include at least one sensor 120. The sensor 120 is fixedly disposed on the main body 10, and electrically connected to the control module 40 (as shown in FIG. 1). When sensing a predetermined organism (such as a human being), the sensor 120 transmits a sensing signal to the control module 40. For example, the sensor 120 can be an infrared sensor, an ultrasonic sensor, or an image capture device, which is not limited thereto. The position of the sensor 120 can be selected according to practical requirements. For example, the sensor 120 can be disposed at the main body 10, the joint fixing member 30 or the casing 20.

Based on the above, the manufacturers can meet customer demands merely by appropriately changing the length of the joint fixing member, and do not need to build different molds for different requirements of brightness and design different casings and main bodies. The manufacturers only have to correspondingly connect joint fixing members in different lengths to different numbers of main bodies and casings, such that the lamp can have different numbers of lighting-emitting modules so as to emit light beams with different brightness. Since the joint fixing member has a simple structure and low production cost, and each of the main bodies (casings) of the lamp is the same component, the manufacturers can easily manage inventory and materials.

Figure 9:
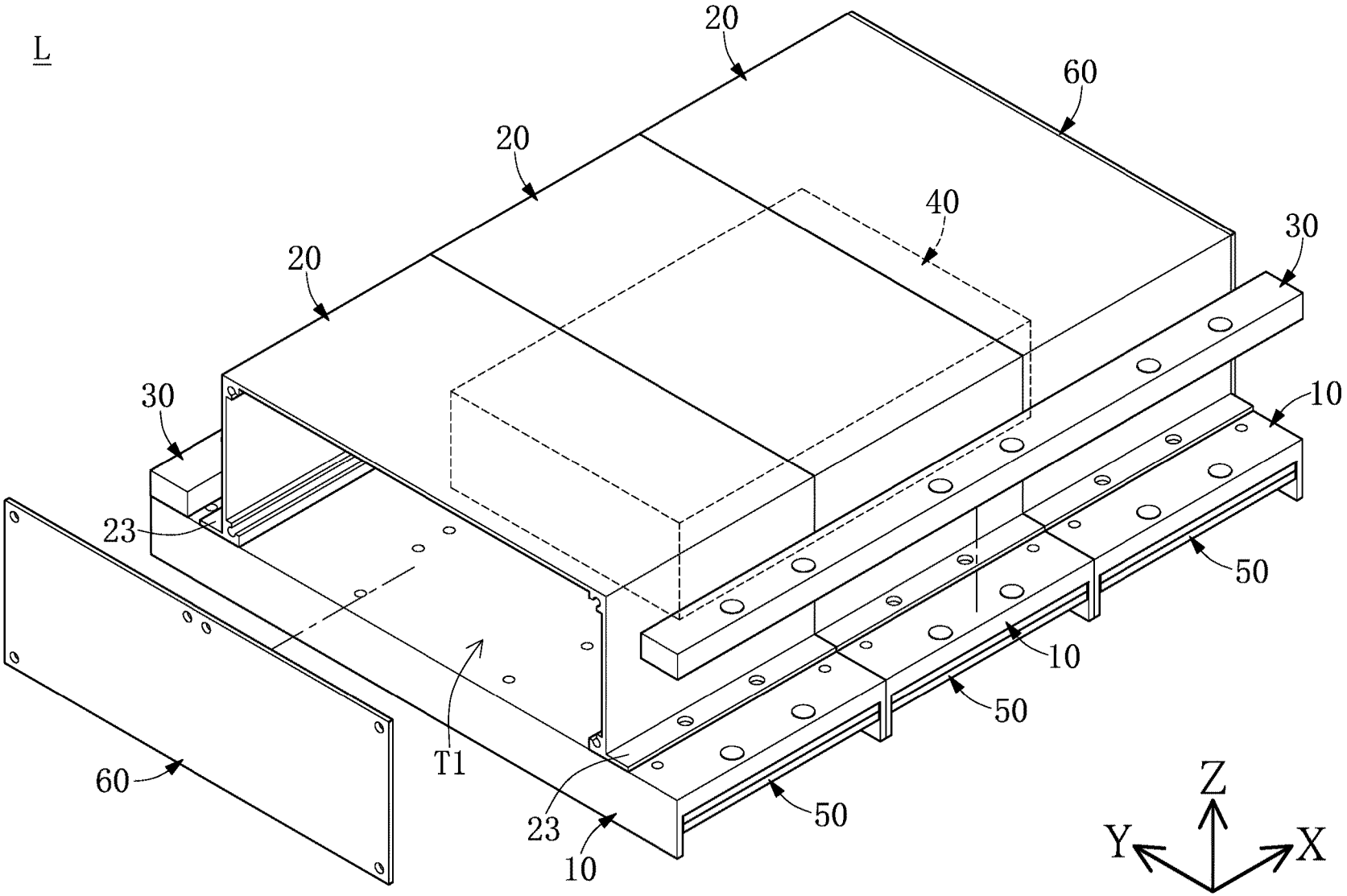
FIG. 9 is a partially exploded view of the lamp according to a fourth embodiment of the present disclosure.
Figure 10:
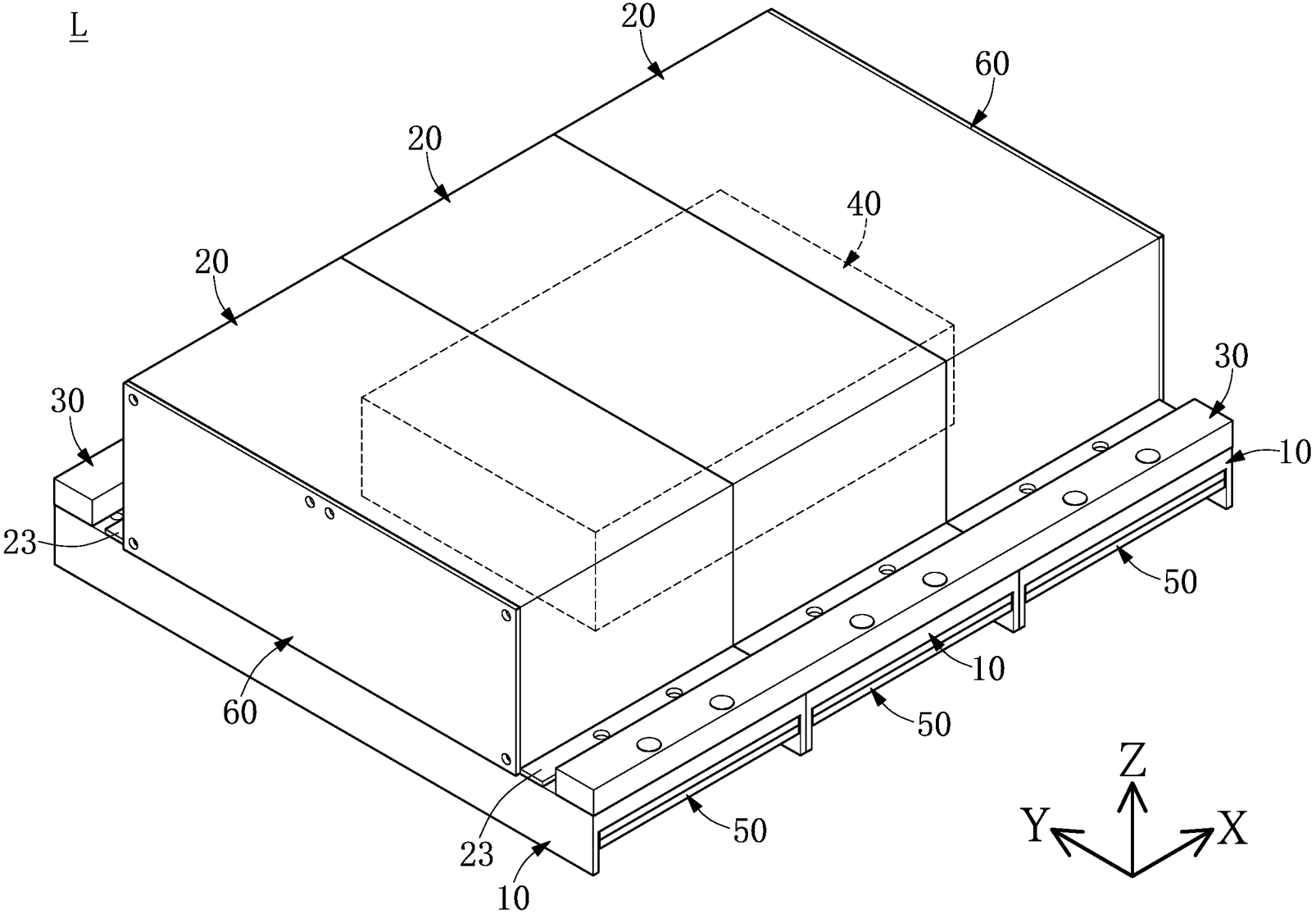
FIG. 10 is an assembled schematic view of the lamp according to the fourth embodiment of the present disclosure.
Figure 11:
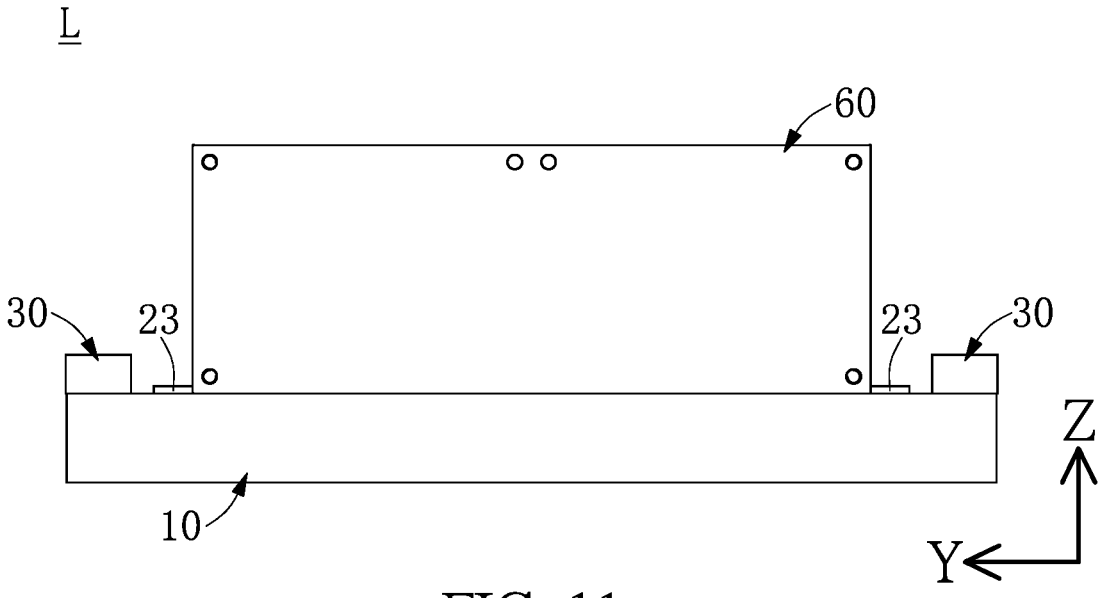
FIG. 11 is a front view of the lamp according to the fourth embodiment of the present disclosure.

FIG. 9 to FIG. 11 are schematic views of the lamp according to a fourth embodiment of the present disclosure. In the aforementioned embodiments, each of the joint fixing members 30 fixes the plurality of casings 20 and the plurality of main bodies 10 at the same time, and one of the fixing walls 23 of each of the casings 20 is located between the joint fixing member 30 and corresponding one of the main bodies 10.

The two joint members 30 of this embodiment are merely fixed to the plurality of main bodies 10 without being fixed to the plurality of casings 20, and each of the casings 20 is detachably fixed to the main body 10, such that a user can remove only the casing 20 while other components are maintained in connection with each other.

Figure 12:
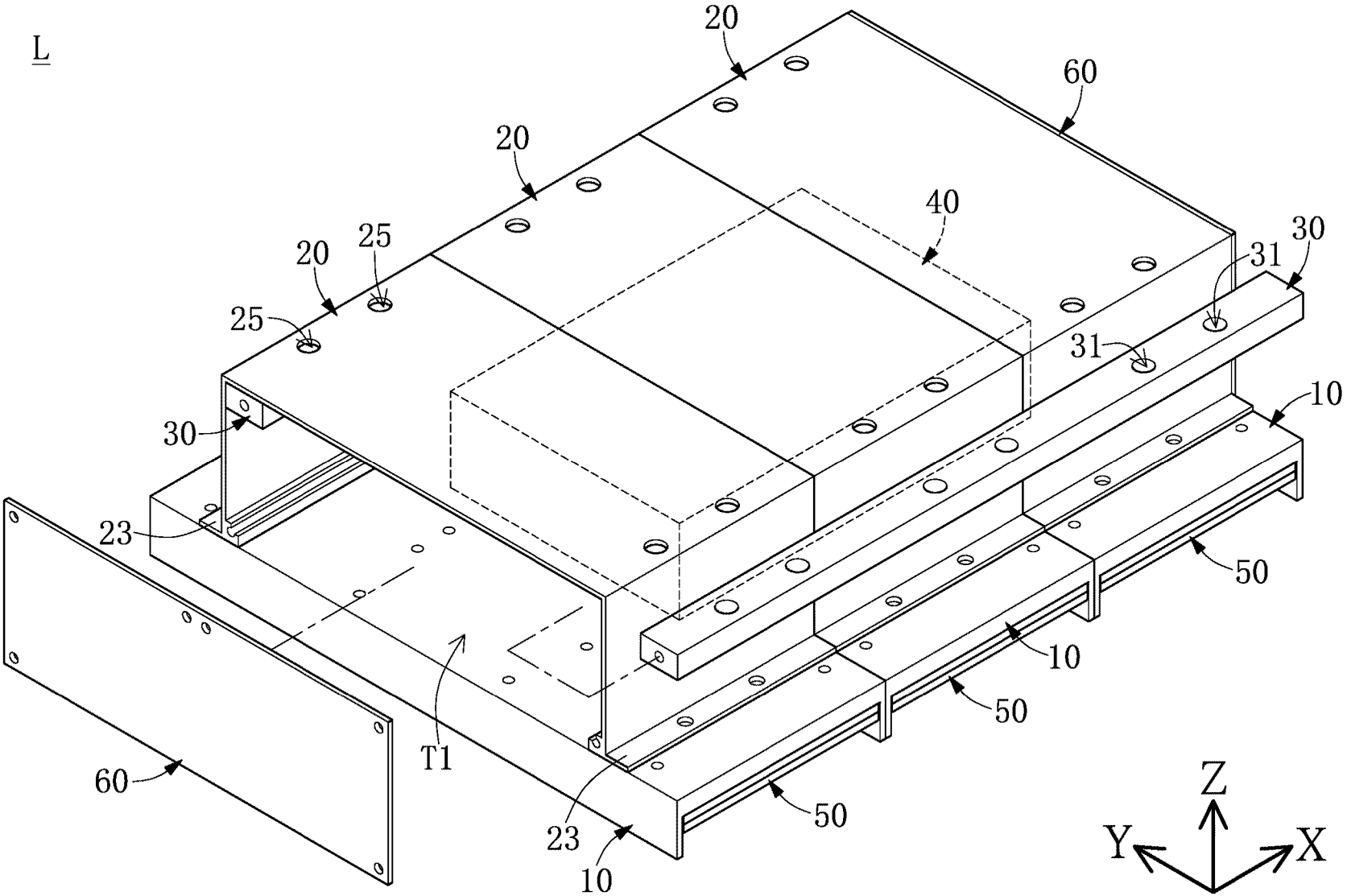
FIG. 12 and FIG. 13 are partially exploded views of the lamp according to a fifth embodiment of the present disclosure.
Figure 13:
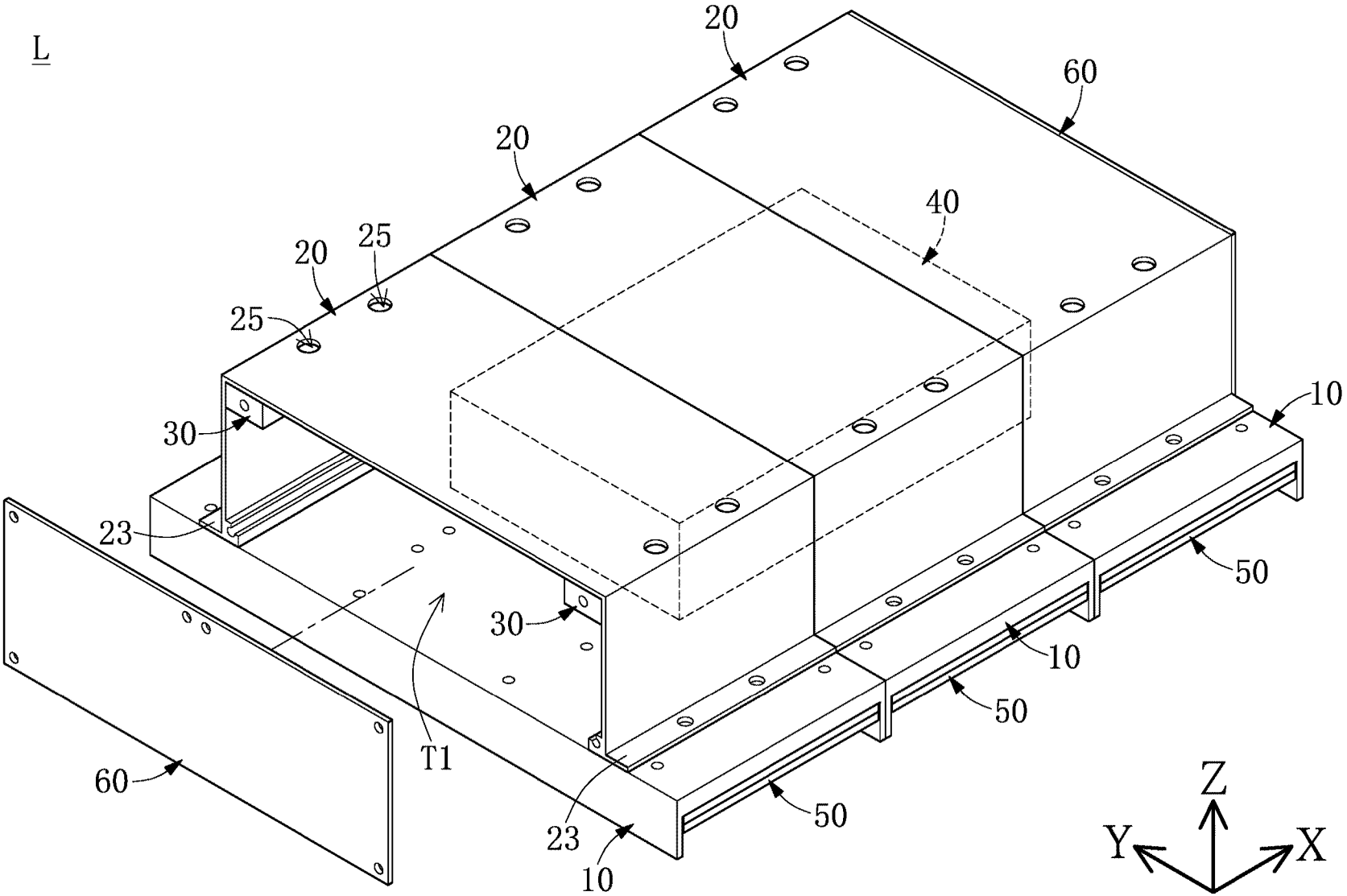

FIG. 12 and FIG. 13 are schematic views of the lamp according to a fifth embodiment of the present disclosure. The difference between this embodiment and the aforementioned embodiment is that: the two joint fixing members 30 are fixed to the plurality of casings 20 without being fixed to the plurality of main bodies 10, and the two joint members 30 may be correspondingly disposed in the through passage formed by the passages T1 communicating with each other in the casings 20.

In practical applications, the plurality of casings 20 can have a plurality of locking holes 25, each of the joint fixing members 30 can have a corresponding locking hole 31, and the locking hole 31 of each of the joint fixing members 30 and the locking hole 25 of each of the casings 10 can cooperate with the plurality of lock members and the casings 20 to fix each other together.

Accordingly, in practical applications, when the plurality of casings 20 arranged side by side are defined as a casing group and the plurality of main bodies 10 arranged side by side are defined as a main body group, the two joint fixing members 30, the casing group and the main body group can be fixed to each other according to practical requirements. For example, the two joint fixing members 30 are only fixed to the casing group, the two joint fixing members 30 are only fixed to the main body group, or the two joint fixing members 30 are fixed to the casing group and the main body group at the same time.

Figure 14:
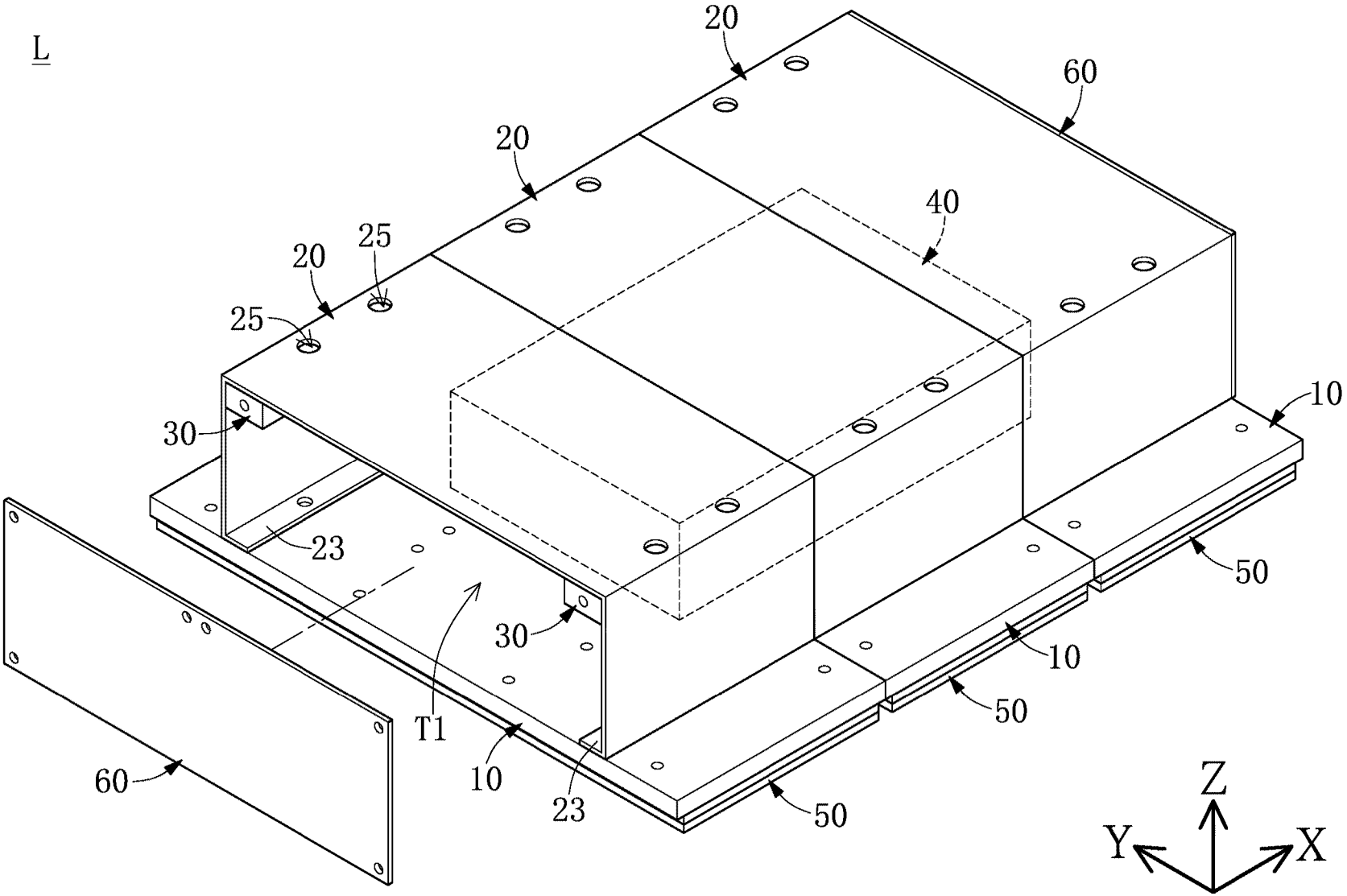
FIG. 14 is a schematic view of the lamp according to a sixth embodiment of the present disclosure.

FIG. 14 is a schematic view of the lamp according to a sixth embodiment of the present disclosure. The difference between this embodiment and the aforementioned embodiment is that: the main body 10 can be formed without the groove 101 illustrated in the aforementioned embodiment, and the entire main body 10 can be a flat plate. In addition, the fixing walls 23 of the casing 20 can be disposed without protruding outward, and each of the fixing walls 23 can be formed by extending an end of one of the side walls 22 of the casing 20 toward the other of the side walls 22.

In other words, the two side walls 22 of each of the casings 20 are disposed facing each other, and each of the side walls 22 of each of the casings 20 is distant from an end connected to the top wall 21, and extends in a direction away from the other side wall 22 to form the fixing wall 23 (as shown in FIG. 9), or each of the side walls 22 of each of the casings 20 is distant from the end connected to the top wall 21, and extends in a direction toward the other side wall 22 to form the fixing wall 23 (as shown in FIG. 14).

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A lamp, comprising:

a plurality of main bodies that are bar-shaped, wherein each of the main bodies has a through hole passing through the main body, and two side surfaces of each of the main bodies opposite to each other are defined as a first mounting surface and a second mounting surface;

a plurality of casings that are bar-shaped, wherein each of the casings includes a top wall, two side walls and two fixing walls, the top wall, the two side walls and the two fixing walls are integrally formed, two side edges of the top wall opposite to each other extend toward a first direction to form the two side walls respectively, the two side walls face each other, side edges of the two side walls opposite to the side edges connected to the top wall extend toward a second direction to form the two fixing walls, and the second direction is not parallel to the first direction;

wherein the two fixing walls of each of the casings are fixedly disposed on the main body, the top wall, the two side walls and the first mounting surface jointly form a passage, and the through hole of the main body is correspondingly located in a region defined by an orthographic projection in a direction from the top wall toward the main body;

wherein a length of each of the fixing walls in a lateral direction is equal to a length of a short side edge of the main body in the lateral direction and a sum of a length of each of the top walls of each of the casings in a length direction and lengths of the two fixing walls in the length direction is not greater than a length of a long side edge of the main body in the length direction;

wherein the plurality of casings are arranged side by side and defined as a casing group, and the plurality of casings of the casing group have the plurality of passages communicating with each other to form a through passage; the plurality of main bodies are arranged side by side and defined as a main body group;

two joint fixing members each used to fix at least one of the casing group and the main body group;

two cover plates fixedly disposed on two sides of the plurality of casings and the plurality of main bodies arranged side by side with each other, wherein the two cover plates close off openings at two ends of the through passage, respectively, and the two cover plates, the first mounting surfaces of the plurality of main bodies and the plurality of casings jointly form a closed space;

a control module fixedly disposed in at least one of the plurality of main bodies and located in the closed space; and a plurality of lighting-emitting modules, wherein each of the lighting-emitting modules is fixedly disposed on the second mounting surface of each of the main bodies, each of the lighting-emitting modules has a circuit board, a plurality of lighting-emitting units and a light-transmitting component, the circuit board is fixedly disposed on the second mounting surface of the main body, the plurality of lighting-emitting units are fixedly disposed on a side of the circuit board away from the second mounting surface, the light-transmitting component is fixedly disposed on a side of the circuit board away from the second mounting surface, and the light-transmitting component correspondingly covers the plurality of lighting-emitting units;

wherein each of the light-transmitting components includes a plurality of lens structures, the plurality of lighting-emitting units correspond to the plurality of lens structures, and a light beam emitted by each of the lighting-emitting units radiates outward through the corresponding lens structure; each of the light-transmitting components has a light-emergent surface, a portion of the light beams emitted by the plurality of light units directly passes through the light-emergent surface to radiate outward, and the portion of the light beams emitted by the plurality of light units is guided by the lens structures to radiate toward an optical axis close to the lens structures;

wherein each of the lighting-emitting modules has at least one electrical connection line, the electrical connection line passes the through hole and is electrically connected to the control module in the closed space, and the control module controls each of the lighting-emitting modules.

2. The lamp according to claim 1, wherein the lamp further comprises a handle structure, the handle structure is disposed on at least one of the plurality of main bodies, the handle structure includes a pivot structure, and the handle structure is rotated relative to the connected main body through the pivot structure.

3. The lamp according to claim 1, wherein a groove is recessed in a side of each of the main bodies, the second mounting surface is located at the bottom of the groove, each of the lighting-emitting modules is correspondingly located in each of the grooves, and an inner side surface of side walls formed with each of the grooves absorbs the light beam emitted by the lighting-emitting module.

4. The lamp according to claim 1, wherein the lamp further comprises at least one sensor, the sensor is fixedly disposed on the main body, the casing, or the joint fixing member, the sensor is electrically connected to the control module, and when sensing a predetermined organism, the sensor transmits a sensing signal to the control module.

5. The lamp according to claim 1, wherein a side of each of the casings facing the main body is formed with four auxiliary fixing structures, two of the auxiliary fixing structures are respectively formed at positions where the top wall is connected to the two side walls, the other two of the auxiliary fixing structures are formed at positions where the two side walls are connected to the two fixing walls, and each of the auxiliary fixing structures cooperates with a lock member to fix the cover plate to a side of the casing.

6. The lamp according to claim 1, wherein each of the light-transmitting components includes a light-emergent surface and four side light-emergent surfaces, an inner side surface of the side wall of each of the main bodies is disposed with a light absorbing structure capable of absorbing the light beam emitted by the adjacent side light-emergent surface.

7. The lamp according to claim 1, wherein each of the joint fixing members has a plurality of locking holes corresponding to the plurality of casings, each of the joint fixing members and the plurality of casings are fixed to each other through a plurality of lock members, and each of the joint fixing members is located in the through passage.

8. The lamp according to claim 7, wherein the two side walls of each of the casings are disposed facing each other, and each of the side walls of each of the casings is distant from an end thereof connected to the top wall, and extends in a direction away from or toward the other side wall to form the fixing wall.

9. The lamp according to claim 1, wherein each of the joint fixing members and the plurality of the main bodies are fixed to each other, the plurality of casings and the plurality of main bodies are fixed to each other, and each of the joint fixing members is not fixed to the plurality of casings.

10. The lamp according to claim 1, wherein each of the joint fixing members is fixed to the plurality of casings and the plurality of main bodies at the same time, and one of the fixing walls of each of the casings is located between the joint fixing member and a corresponding one of the main bodies.

* * * * *